US010435218B1

(12) United States Patent
Little et al.

(10) Patent No.: US 10,435,218 B1
(45) Date of Patent: Oct. 8, 2019

(54) SHEET-METAL AMMUNITION PACKING TRAY

(71) Applicants: Gregory D. Little, Ashland, VA (US); John P. Shebalin, Fredericksburg, VA (US); James S. Fetsko, Fredericksburg, VA (US); Joseph A. Silber, King George, VA (US); John E. Brough, Fredericksburg, VA (US)

(72) Inventors: Gregory D. Little, Ashland, VA (US); John P. Shebalin, Fredericksburg, VA (US); James S. Fetsko, Fredericksburg, VA (US); Joseph A. Silber, King George, VA (US); John E. Brough, Fredericksburg, VA (US)

(73) Assignee: United States of America, as represented by the Secretary of the Navy, Arlington, VA (US)

( * ) Notice: Subject to any disclaimer, the term of this patent is extended or adjusted under 35 U.S.C. 154(b) by 287 days.

(21) Appl. No.: 15/584,276

(22) Filed: May 2, 2017

Related U.S. Application Data

(60) Provisional application No. 62/398,476, filed on Sep. 22, 2016.

(51) Int. Cl.

| | |
|---|---|
| ***B65D 71/70*** | (2006.01) |
| ***B65D 21/02*** | (2006.01) |
| *F41A 9/09* | (2006.01) |

(52) U.S. Cl.
CPC ..... *B65D 71/70* (2013.01); *B65D 21/02* (2013.01); *B65D 21/0233* (2013.01); *F41A 9/09* (2013.01)

(58) Field of Classification Search
CPC ..... B65D 21/02; B65D 21/0233; B65D 2571/00043; B65D 71/70; B65D 71/72; F41A 9/09; F41A 9/76; F42B 39/00
(Continued)

(56) References Cited

U.S. PATENT DOCUMENTS 4,501,363 A * 2/1985 Isbey, Jr. ..... A61B 50/33 206/363
5,251,572 A * 10/1993 Frame ..... A01K 1/0236 119/417

(Continued)

*Primary Examiner* — James N Smalley
*Assistant Examiner* — Madison L Poos
(74) *Attorney, Agent, or Firm* — Gerhard W. Thielman

(57) ABSTRACT

An ammunition tray is provided for containing a plurality of bullet cartridges within an ammunition box container having a stowage volume. The tray includes a substantially rectangular template having a horizontal surface bounded by first and second opposing longitudinal edges and opposing lateral edges joined at four corners. Each longitudinal edge includes a first tab bent substantially perpendicular to the surface to form a rib. Each lateral edge includes a second tab bent substantially perpendicular to the surface to form a wall. The surface includes a first row of internal cutouts that point towards the first longitudinal edge as a proximal orientation. The surface further includes a second row of internal cutouts that point towards the second longitudinal edge as a distal orientation. The template has longitudinal and lateral edges bent to form the respective ribs and walls fits within the stowage volume as a vertical stack of plural templates. Each first internal cutout in the first row can cradle a cartridge on the surface along the proximal orientation and can fit the cartridge from an adjacent second row. Each second internal cutout in the second row can cradle the cartridge on the surface along the distal orientation and can fit the cartridge from an adjacent first row.

8 Claims, 8 Drawing Sheets

(58) Field of Classification Search
USPC ..... 206/503
See application file for complete search history.

(56) References Cited

U.S. PATENT DOCUMENTS

| | | | | |
|---|---|---|---|---|
| 5,409,560 | A * | 4/1995 | Hammer | B25H 3/003 156/248 |
| 2004/0238398 | A1* | 12/2004 | Wilson | B65D 71/70 206/564 |
| 2009/0026157 | A1* | 1/2009 | Gibert Guasch | B65D 71/70 211/74 |

* cited by examiner

SHEET-METAL AMMUNITION PACKING TRAY

CROSS REFERENCE TO RELATED APPLICATION

Pursuant to 35 U.S.C. § 119, the benefit of priority from provisional application 62/398,476, with a filing date of Sep. 22, 2016, is claimed for this non-provisional application.

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to ammunition packing trays. In particular, the invention provides stackable sheet metal trays for stowing bullet cartridges in an ammunition box.

Ordnance ammunition is conventionally packaged within trays composed of high density polyethylene (HDPE). Conventional HDPE cradle packaging can ignite from weapons impact, which can cause delayed cook-off reactions of damaged or undamaged rounds in the stowage container. This constitutes a serious hazard to the warfighter.

SUMMARY

Conventional ammunition dunnage trays yield disadvantages addressed by various exemplary embodiments of the present invention. In particular, exemplary embodiments provide a dunnage tray for holding ammunition cartridges within an ammunition box container having a stowage volume. The tray includes a substantially rectangular template having a horizontal surface bounded by first and second opposing longitudinal edges and opposing lateral edges joined at four corners. Each longitudinal edge includes a first tab bent substantially perpendicular to the surface to form a rib. Each lateral edge includes a second tab bent substantially perpendicular to the surface to form a wall.

In exemplary embodiments, the surface includes a first row of internal cutouts that point towards the first longitudinal edge as a proximal orientation. The surface further includes a second row of internal cutouts that point towards the second longitudinal edge as a distal orientation. The template has longitudinal and lateral edges bent to form the respective ribs and walls fits within the stowage volume as a vertical stack of plural templates.

Each first internal cutout in the first row can cradle a cartridge on the surface along the proximal orientation and can fit the cartridge from an adjacent second row. Each second internal cutout in the second row can cradle the cartridge on the surface along the distal orientation and can fit the cartridge from an adjacent first row. Other various embodiments alternatively provide for external cutouts at the corners along the first longitudinal edge. In additional embodiments, each wall supports an adjacent tray disposed above.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

Figure 1A:
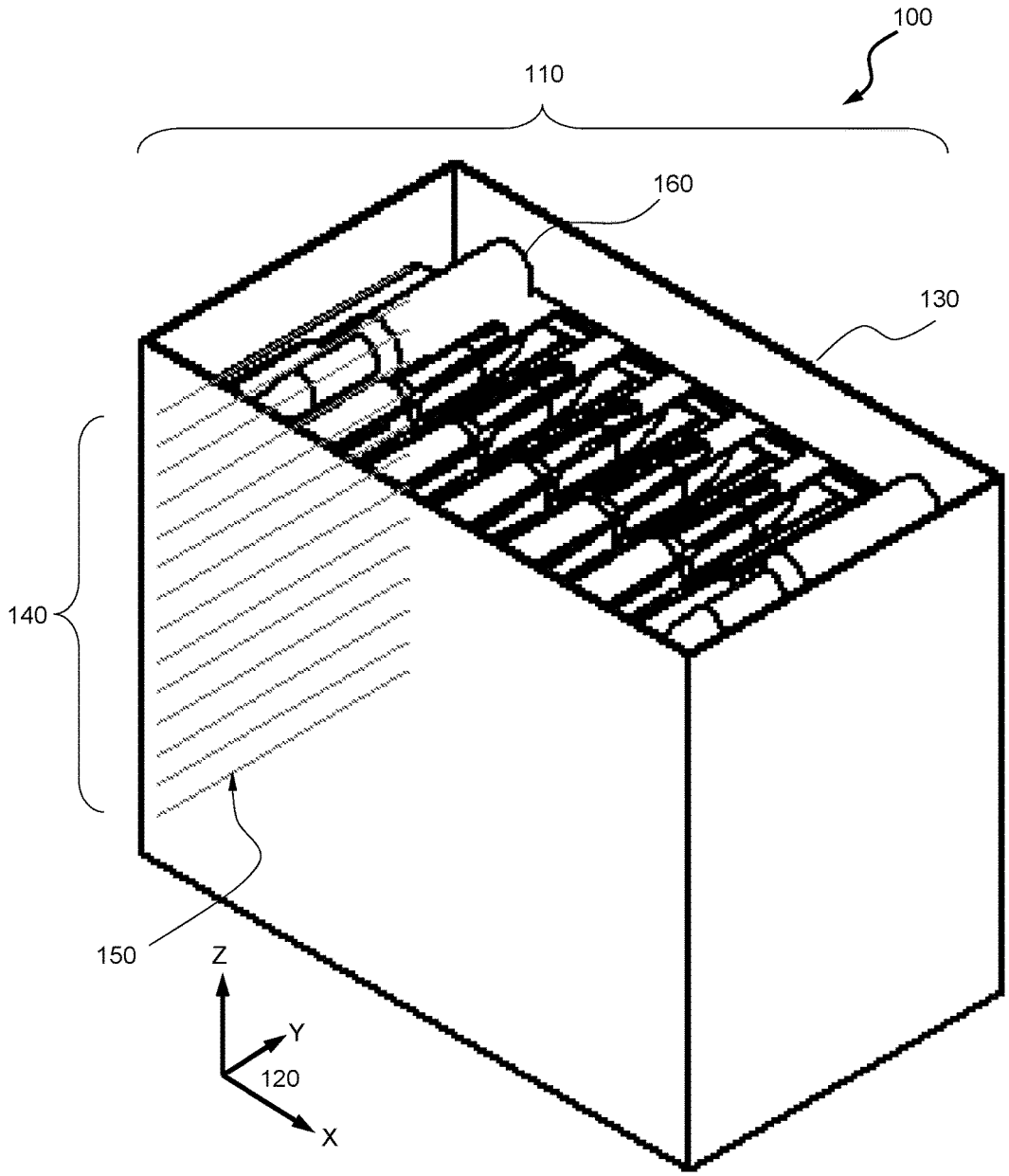
FIG. 1A is an isometric view of an ammunition box.

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

One of the objectives of the exemplary embodiments presented herein includes improvement of the Insensitive Munition and safety properties of ammunition packaging. The exemplary non-flammable dunnage tray mitigates this hazardous risk.

Recent testing of 25 mm (millimeter) caliber high explosive armor piercing ordnance for Insensitive Munitions (IM) evaluation revealed susceptibility of conventional HDPE packing trays used for decades by the United States armed services to catching fire in particular IM impact scenarios. Delayed cook-off reactions of remaining cartridge rounds caused by these burning trays were observed as long as forty-two minutes after the impact that initiated the reaction. This cook-off scenario poses a serious threat to personnel safety, as the cans containing burning trays do not necessarily emit large volumes of smoke and so can appear safe to approach from a distance.

Replacement of the tray material with something non-flammable, less flammable, or containing less potential chemical energy that satisfies other packaging requirements (cost, weight, vibrational, etc.) could eliminate this hazard. Often, as in this case, packaged units of ammunition have already reached their logistical weight limit, so any solution must weigh the same as or less than the conventional HDPE packing material. For the purposes of this disclosure, a specific ammo can, the CNU-405/E packaged with unlinked 25 mm ammunition, is under examination, but the technology has broad applicability across any ammunition or ordnance packaged in trays of this type. Artisans of ordinary skill will recognize that the dimensions and stowage of unlinked ammunition described herein are exemplary and not limiting to other ordnance sizes.

Several materials were investigated that could serve as a replacement to HDPE. These included novel fire resistant or fire retardant plastics such as bishydroxydeoxybenzoin (BHDB), thermoplastics with lower potential energy such as polypropylene, reconstituted fiber-based products such as bagasse, well-characterized fire resistant meta-aramids such as Nomex™, and fireproof minerals such as vermiculite. Each of these was ultimately discarded due to such issues as insufficient Manufacturing Readiness Level, noxious off-gassing from combustion, poor workability and capacity to hold a constant shape, volumetric and weight requirements, vibrational requirements and humidity requirements. Ultimately, aluminum was selected as the candidate material with which to proceed.

FIG. 1A shows an isometric view 100 of an exemplary stowage configuration 110 with a compass rose 120 of a CNU-405/E ammunition can 130 (configured as a box container) with exemplary dunnage. The compass rose 120 depicts directions for length X, depth Y and height Z. The ammunition can 130 contains vertically arranged loading stacks 140 of exemplary trays, each level denoted by a line 150 that contains bullet cartridges 160. The ammunition can 130 for 25 mm rounds has a mass of 10 kg to 14 kg (22 lbm to 31 lbm) and has internal volume dimensions (in inches) of 17¼" long×9¾" deep×14" high.

Figure 1B:
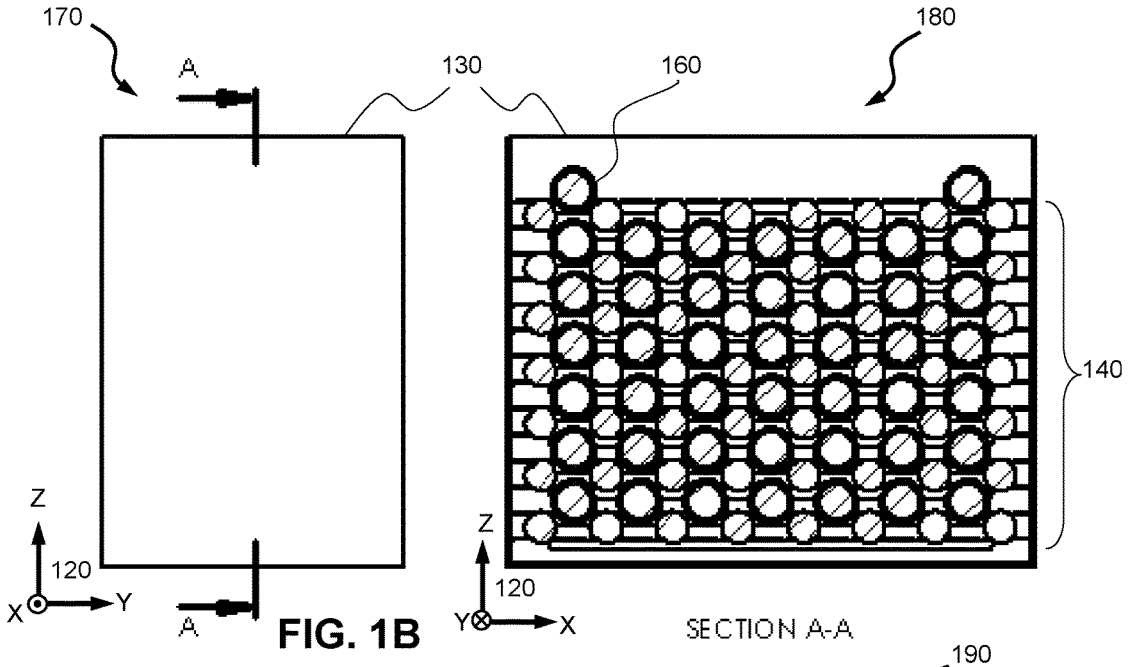
FIG. 1B is an elevation view (front and cross-section) of the ammunition box.
Figure 1C:
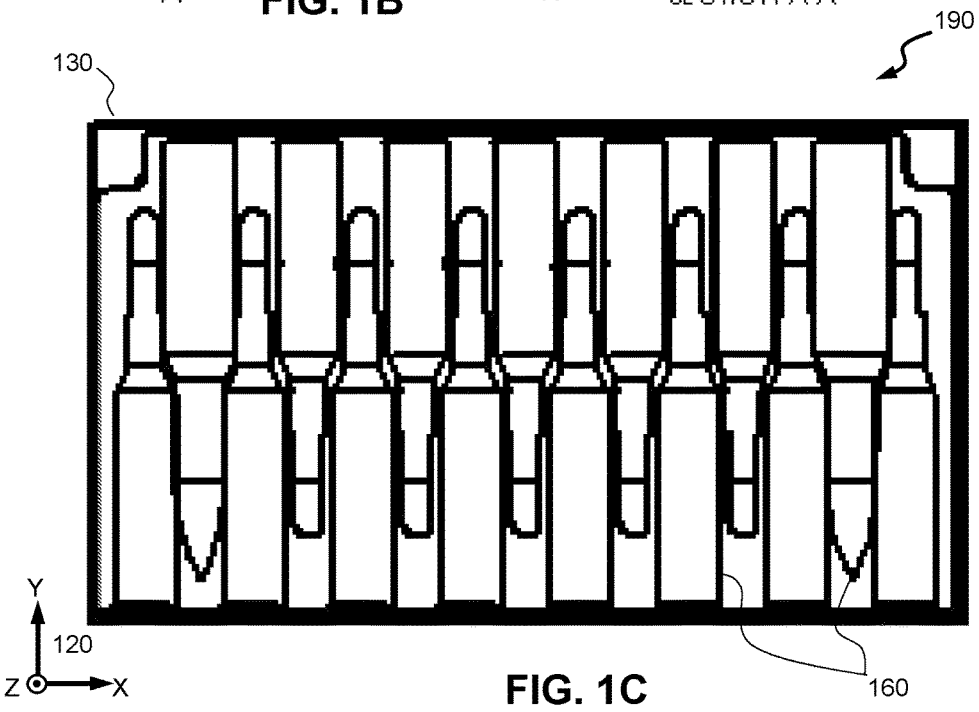
FIG. 1C is a plan view of the ammunition box.

FIG. 1B shows elevation front view 170 and elevation cross-section view 180, midway through the depth along section A-A of the (lidless) stowage configuration 110. View 170 depicts the ammunition can 130 facing the length direction (outward) as indicated by the compass rose 120. View 180 depicts the loading stacks 140 with the cartridges 160 along their axes parallel to the depth direction (inward) as indicated by the compass rose 120. FIG. 1C shows a plan view 190 of the stowage configuration 110 with the cartridges 160 shown along the height direction (downward) as indicated by the compass rose 120.

Figure 2A:
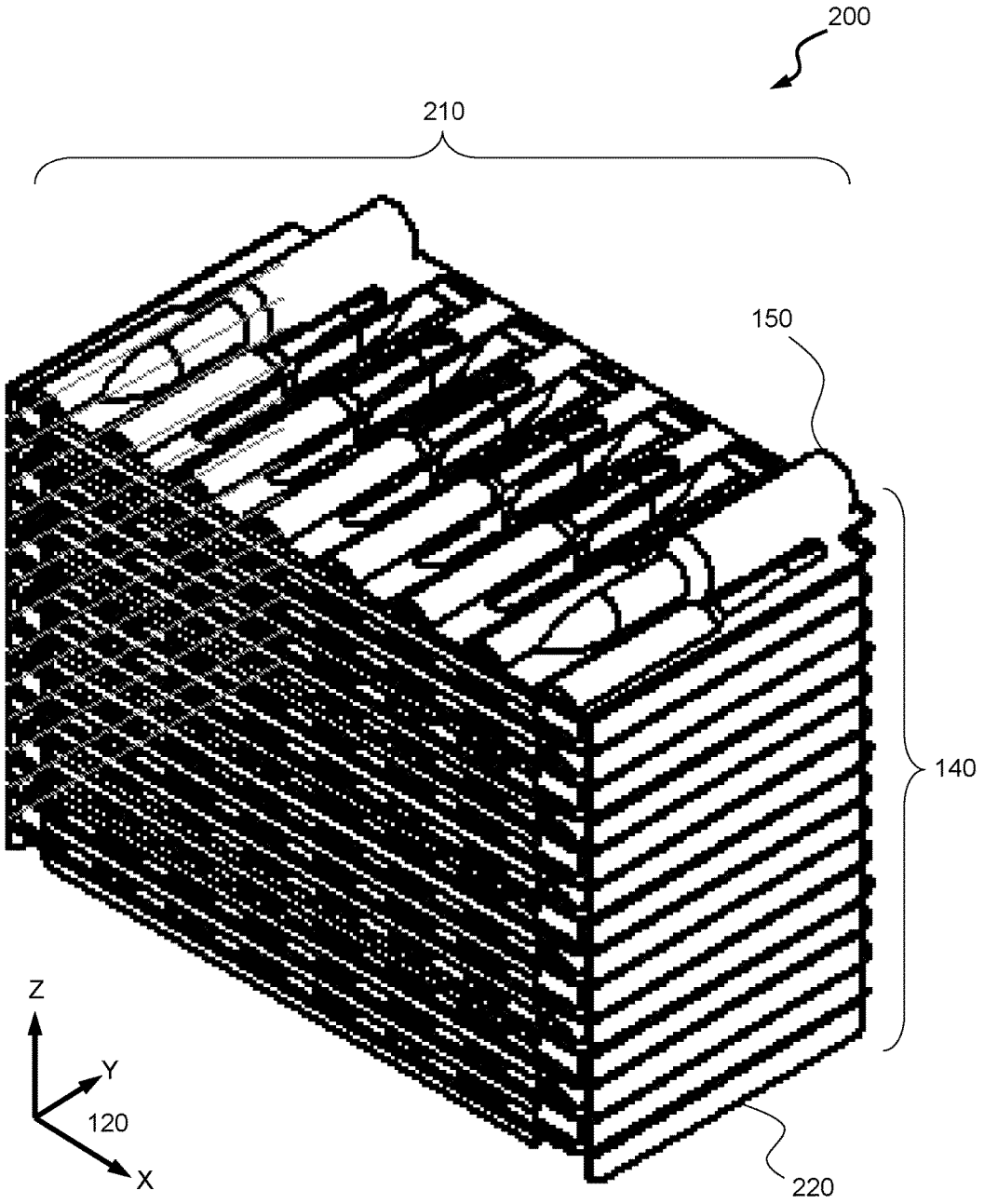
FIG. 2A is an isometric view of a dunnage stack.
Figure 2B:
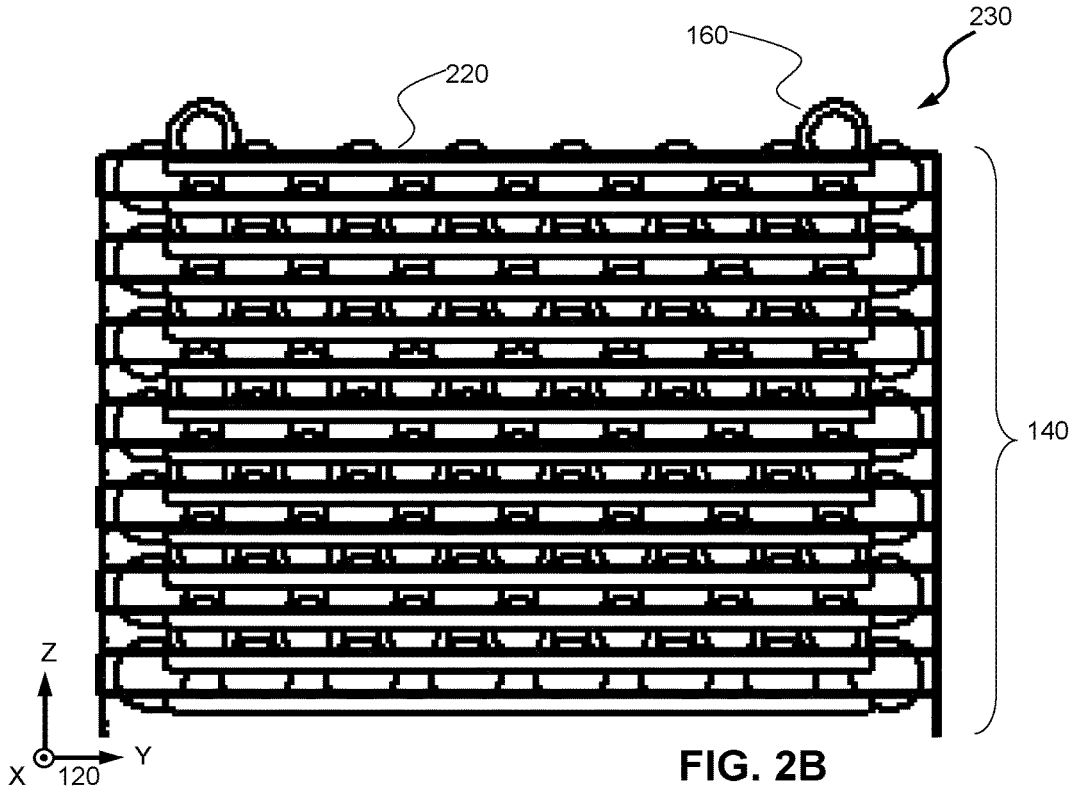
FIG. 2B is an elevation view of the dunnage stack.
Figure 2C:
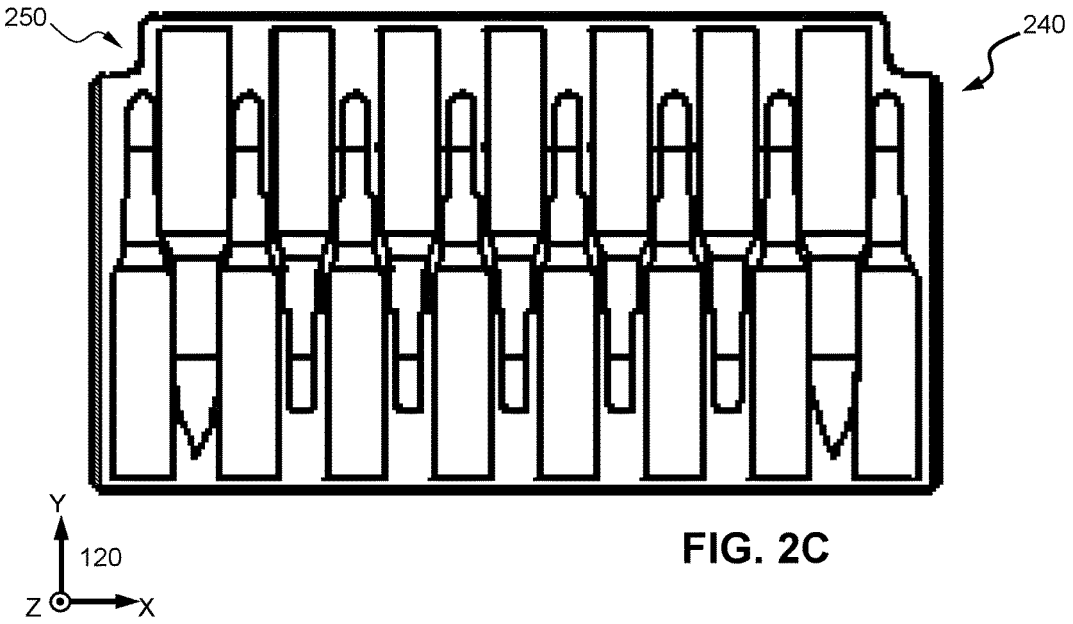
FIG. 2C is a plan view of the dunnage stack.

FIG. 2A shows an isometric view 200 of an exemplary dunnage stack assembly 210 sans ammunition can 130 with individual dunnage trays 210 arranged in the loading stack 140 of separate exemplary trays 220 that contain the cartridges 160. The compass rose 120 depicts directions for length X, depth Y and height Z as for view 100. FIG. 2B shows an elevation side view 230 of the stack assembly 210, with the cartridges 160 along their axes parallel to the depth direction (inward) as indicated by the compass rose 120. FIG. 2C shows a plan view 240 of the stack assembly 210 with the cartridges 160 shown along the height direction (downward) as indicated by the compass rose 120, analogous to configuration view 190. The trays 220 include the corner cutouts 250 at opposite corners along one longitudinal side to facilitate personnel unloading the trays 220 to grip and pull out them from the ammunition can 130.

Figure 3:
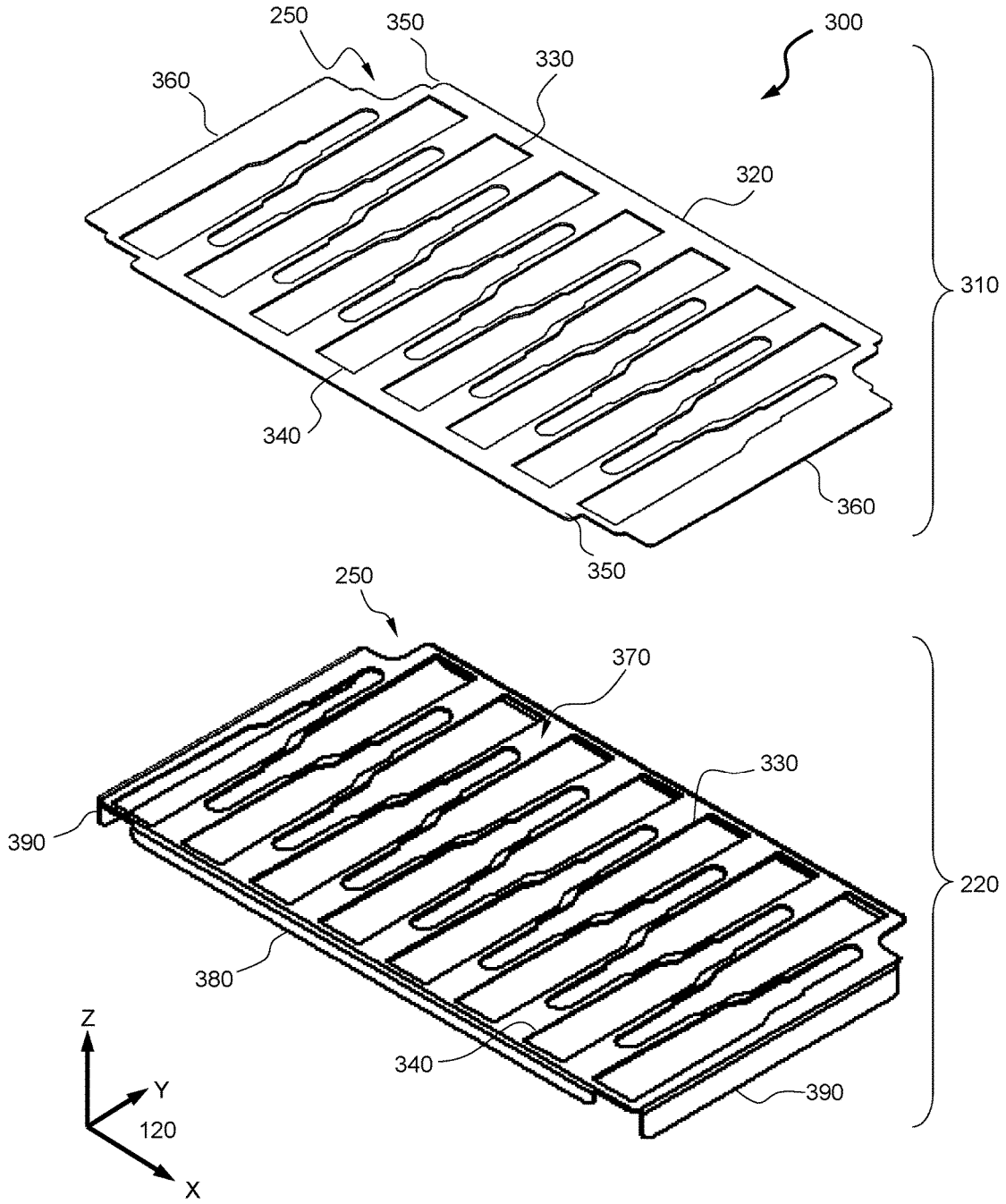
FIG. 3 is an isometric view of a sheet template and folded tray.

FIG. 3 shows an isometric view 300 of a template 310 and an individual tray 220 as folded for insertion into the ammunition can 130. The template 310 has a substantially rectangular shape with opposing longitudinal and lateral edges. The template 310 can be composed of a malleable albeit rigid material provided as a thin sheet 320 to facilitate manufacture by stamp cutting. Preferably, such a template material would be inexpensive and readily available, such as aluminum or alternatively steel. For purposes of this disclosure, the template 310 is described as "thin" as the longitudinal and lateral dimensions are at least one order of magnitude larger than the depth dimension that denotes thickness.

To contain the cartridges 160, the sheet 320 includes alternating interior rows of cutouts oriented to the depth direction facing opposite directions. These alternating cutouts point inward 330 and outward 340, each with a flat base and rounded fore-end. To snugly cradle the cartridges 160, the first row includes seven inward cutouts 330, and the second row includes eight outward cutouts 340. The numbers of cutouts 330 and 340 are exemplary for 25 mm ammunition and not limiting.

The templates 310 are composed of sheet metal ~0.050 inch thick and preferably composed from 5052 aluminum, being more bendable than 6061-T6 aluminum. In the configuration shown, the edge tabs 350 and 360 of each template 310 are bent downward at 90°+(substantially perpendicular) to form a right or acute angle of the folded ribs 380 and walls 390 in relation to the surface 370. As an alternative, the longitudinal edge tabs 350 can be bent upward to provide stiffening, although manufacturing convenience suggests downward orientation as preferable. This produces a rigid shape for the tray 220 that fits snugly within the internal contours of the CNU-405/E ammunition can 130.

The sheet 320 is substantially rectangular in shape with truncated corners 250, and includes longitudinal edge tab 350, lateral edge tab 360. The exemplary tray 220 presents a disposal surface 370 on which the cutouts 330 and 340 are formed. The longitudinal edge tabs 350 are folded downward (in relation to the height direction) to form stiffening ribs 380. Additionally, the lateral edge tabs 360 are similarly folded downward to form stacking walls 390 on opposite sides in relation to the length direction.

Figure 4A:
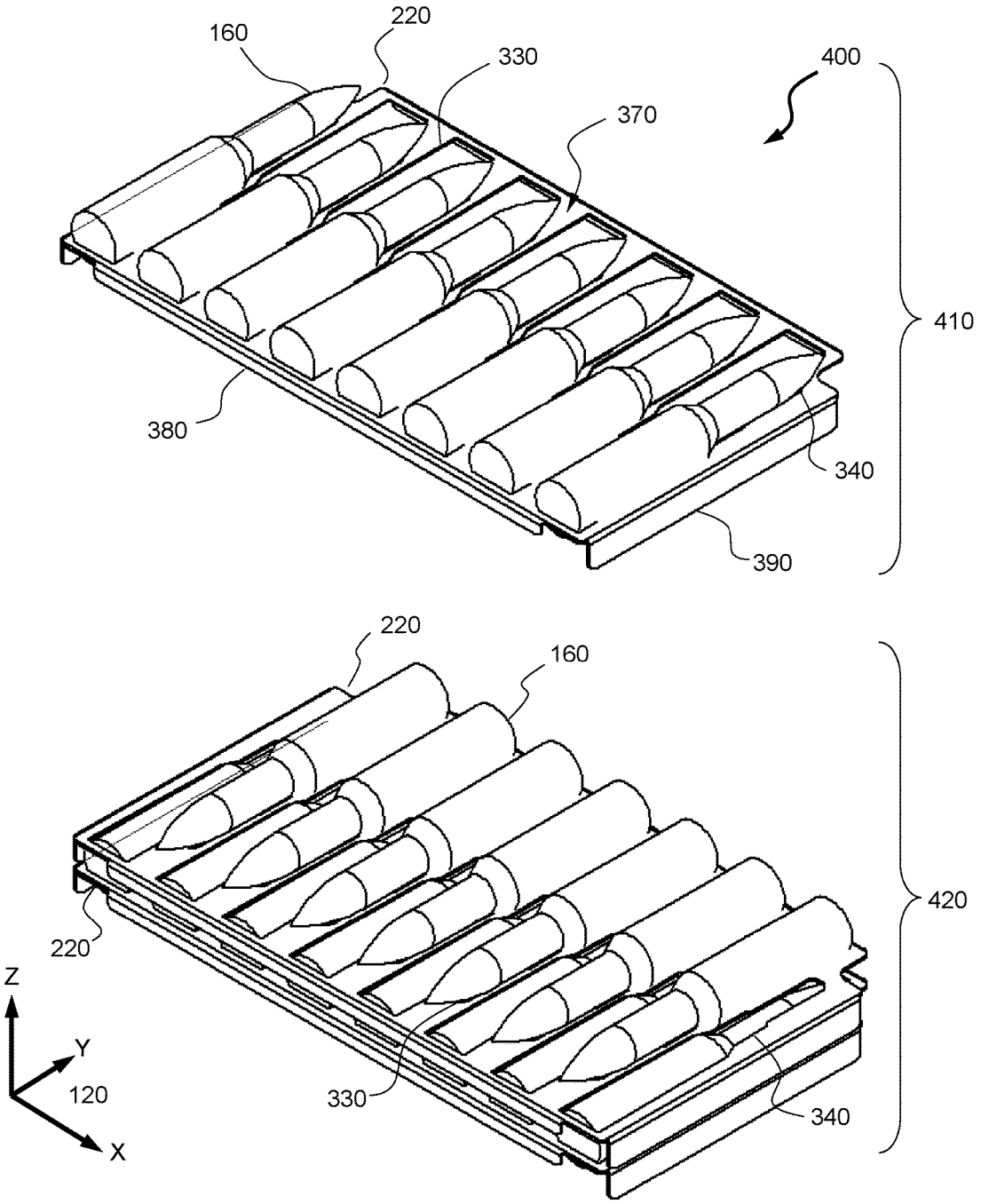
FIG. 4A is an isometric view of a single tray and a two-tray stack holding ammunition.

FIG. 4A shows an isometric view 400 of an exemplary filled tray 410 and an exemplary filled two-tray stack 420. Cartridges 160 are loaded onto the filled tray 410 onto the outward cutouts 340, with the inward cutouts 330 being unoccupied. The stiffening ribs 380 inhibit bending of the tray 220 from the cantilevered weight of the load of cartridges 160. The stacking walls 390 enable trays 220 to be disposed atop another into the loading stack 140.

Figure 4B:
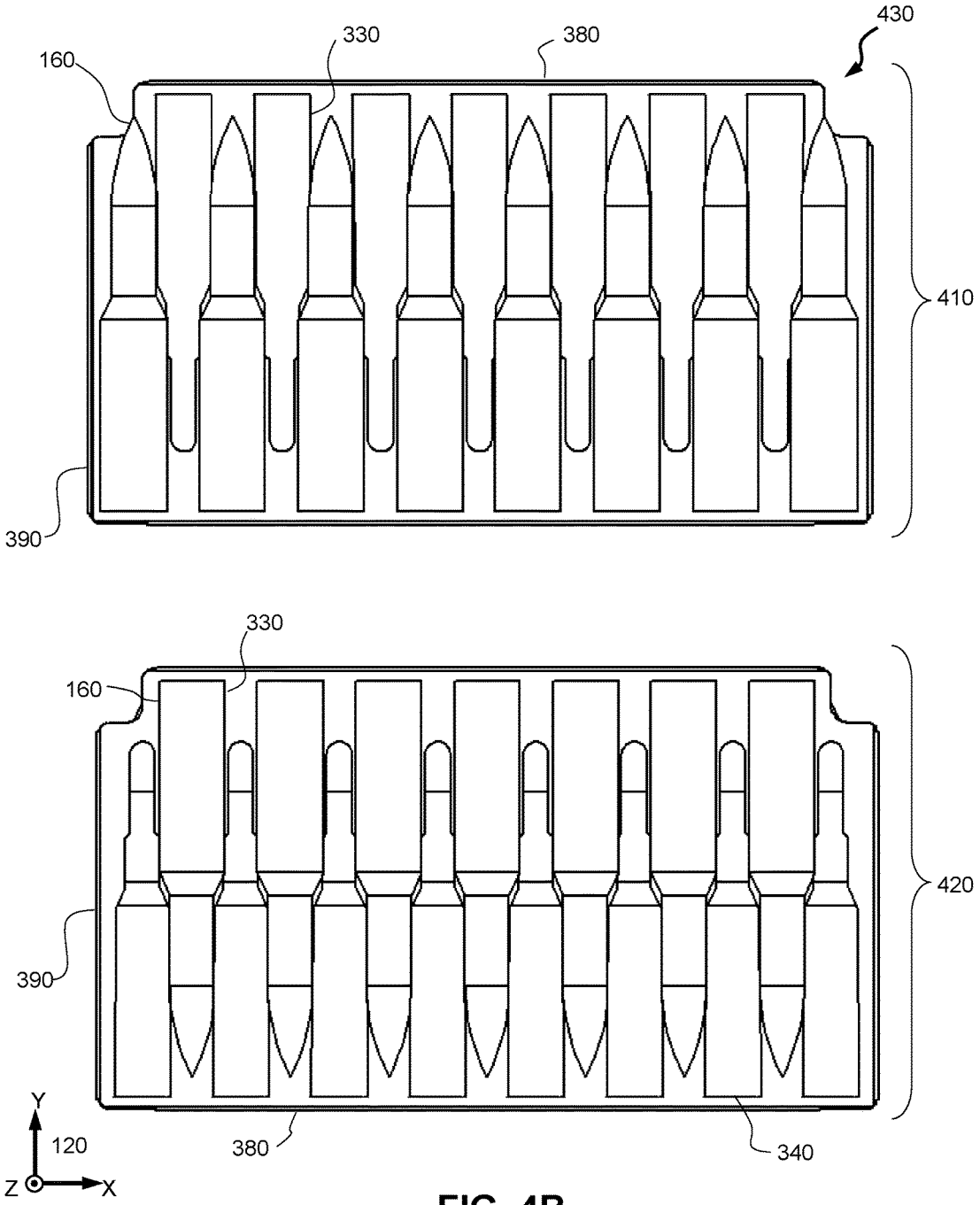
FIG. 4B is a plan view of a single tray and a two-tray stack holding ammunition.

In the two-tray stack 420, a pair of layers 150 of trays 220 loaded with cartridges 160 is shown with the lower unit depicted as the filled tray 410, while the upper unit shown with cartridges 160 loaded onto the inward cutouts 330, with the outward cutouts 330 being occupied by the exposed portions 430 of cartridges 160 contained on the lower unit. FIG. 4B shows a plan view 440 of the exemplary filled tray 410 and the exemplary filled two-tray stack 420.

The rows of interior cutouts 330 and 340 alternate between seven and eight cartridges 160, such as filling the lower unit with the eight outward cutouts 340 and filing the upper unit with the seven inward cutouts 330. A final row of two cartridges 160 in inward cutouts 330 at the very top of the ammunition can 130 yields the required packing density of one-hundred rounds. The rows of cutouts from adjacent trays 220 fit around the cartridges 160, both immediately below and above the filled tray 410.

In this fashion, the cartridges 160 are permitted to nest together, enabling the required packing density of one-hundred rounds per can 130 (for 25 mm rounds) while utilizing the minimum amount of aluminum (thus saving on weight and cost). Thirteen of these trays 220 stack with rows of cartridges 160 (alternating between eight and seven cartridges per row) in between to achieve the required packing density.

Figure 5:
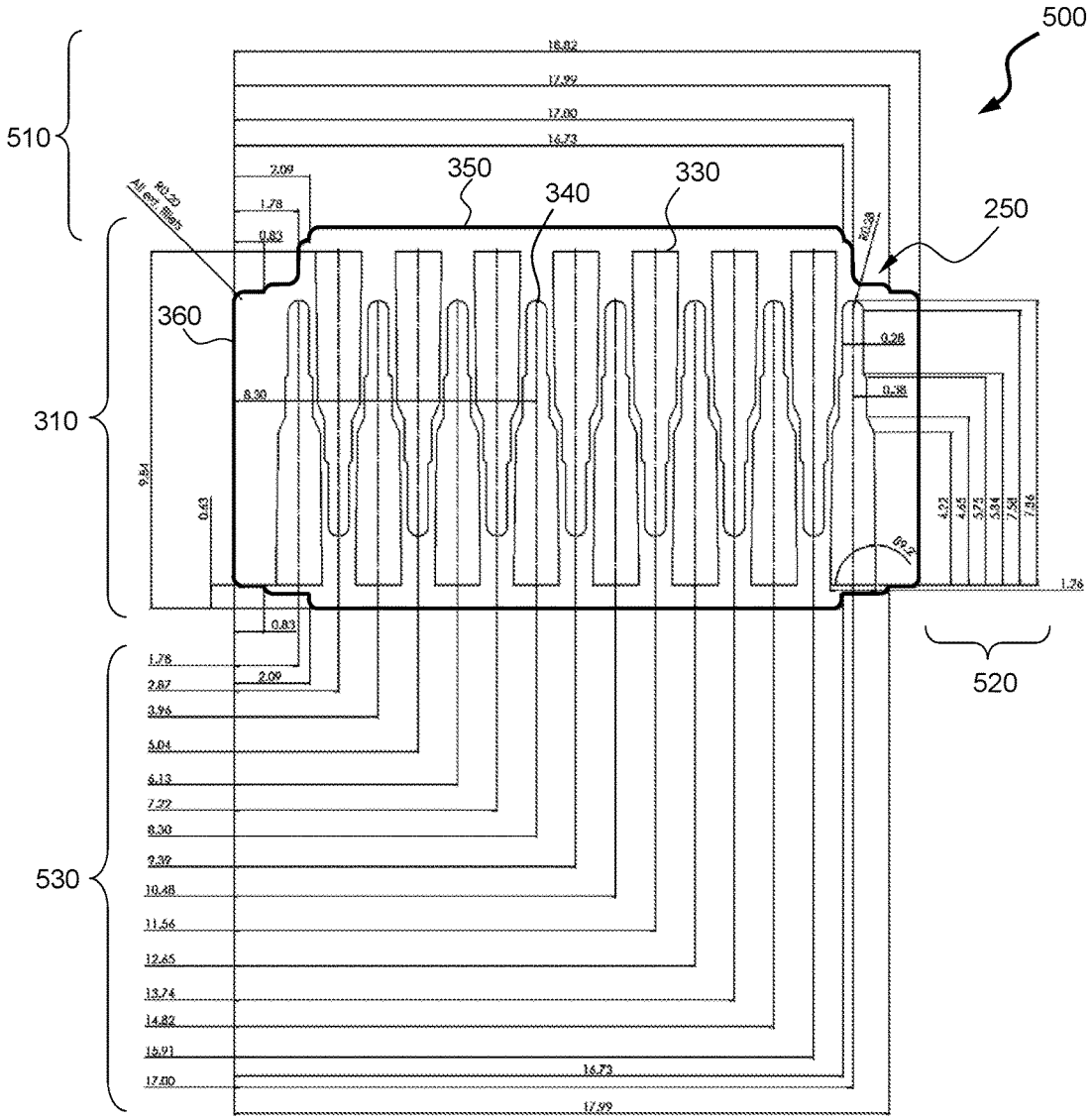
FIG. 5 is a plan view of the sheet template with exemplary dimensions.

FIG. 5 shows a plan view 500 of the sheet template 310 that forms the tray 220. Overall dimensions for length 510 and depth 520 are shown in relation to containing 25 mm armor piercing cartridges. Distributed position spacings 530 for the cutouts 330 and 340 are also shown, along with proposed angles. The overall dimensions also include corner truncation dimensions. Preferable thickness for the aluminum sheet template 310 is about 0.050 inch.

Although as the preferred template material aluminum is combustible, the powder form denotes its preferred ignition mode with ignition temperature of about 730° C. This is above its melting point of 600° C. and well beyond empirical observation temperatures. Replacing the HDPE cradle design with thin aluminum sheet stock can eliminate excess padding material. The exemplary sheet stock has specially shaped cutouts 330 and 340 to support cartridge rounds 160 in a nested pattern of alternating rows with suitable spacing 530, hence reducing both weight and cost. In addition, these cutouts enable internal pressure equalization between trays in the event of sympathetic reaction of a cartridge resulting from impact. This reduces the likelihood of the can's lid being blown off from the propensity of the conventional HDPE tray to behave as a sail in the wind, a potentially lethal hazard observed in testing.

The edge tabs 350 and 360 of the aluminum tray 220 are folded over respectively as ribs 380 and walls 390. These folding structures increase stiffness and enhance durability to produce a more robust and thereby reusable design. This contrasts with the conventional HDPE trays, which are routinely thrown overboard after being unpacking due to cracks and other damage received during handling. In addition, conventional HDPE trays bow substantially when fully loaded, leading to the potential of spilling rounds that the stiffness of the exemplary aluminum trays 220 can inhibit.

Prototype examples of the trays 220 used for testing purposes were cut with a water-jet. The finalized design would be stamped into thin sheets of aluminum. Benefits for this design extend beyond all of the United States armed services (using conventional stowage for unlinked ammunition as well as other ordnance), as allied nations employ the same conventional HDPE packaging trays in their military applications.

This is being proposed to improve munition/ordnance safety while deployed aboard ship and during transport and storage. The exemplary trays 220 do not burn as do conventional HDPE trays, thereby improving safety. Being composed of sheet aluminum and utilizing folded edges, the exemplary configuration 110 is stiffer, stronger and more reusable than the conventional tray arrangement as well at nearly the same mass. By comparison, the weights of the conventional and exemplary trays are 155 grams and 170 grams for 25 mm ammunition. Additionally, the stiffness renders spilling of rounds less likely, mitigating risks from HDPE trays that bow substantially in the center when fully loaded with rounds.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. An ammunition tray for containing a plurality of bullet cartridges within an ammunition box container with a stowage volume, said tray comprising:

a substantially rectangular template composed from sheet metal and having a horizontal surface bounded by first and second opposing longitudinal edges and opposing lateral edges joined at four corners;

a first tab disposed on each longitudinal edge and bent substantially perpendicular to said surface to form a rib;

a second tab on each lateral edge and bent substantially perpendicular to said surface to form a wall;

a first row on said surface of internal cutouts pointing towards said first longitudinal edge as a proximal orientation; and a second row on said surface of internal cutouts pointing towards said second longitudinal edge as a distal orientation, wherein said template having said longitudinal and lateral edges bent to form respective said ribs and walls fits within the stowage volume as a vertical stack of plural templates, each first internal cutout in said first row can cradle a cartridge on said surface along said proximal orientation and can fit the cartridge from an adjacent second row, and each second internal cutout in said second row can cradle the cartridge on said surface along said distal orientation and can fit the cartridge from an adjacent first row.

2. The tray according to claim 1, wherein said template further includes external cutouts at said corners along said first longitudinal edge.

3. The tray according to claim 2, wherein said cutouts are produced by stamping.

4. The tray according to claim 2, wherein said cutouts are produced by water-jet cutting.

5. The tray according to claim 1, wherein said wall on said each lateral edge points down in relation to said surface.

6. The tray according to claim 5, wherein said wall supports an adjacent tray disposed above.

7. The tray according to claim 1, wherein said template is formed from aluminum sheet metal.

8. The tray according to claim 7, wherein said aluminum sheet metal is composed of 5052 aluminum.

* * * * *